US005136206A

United States Patent [19]

Van Heel et al.

[11] Patent Number: 5,136,206

[45] Date of Patent: Aug. 4, 1992

[54] LOW-PRESSURE MERCURY VAPOR DISCHARGE LAMP SUITABLE FOR ILLUMINATING A COLOR ORIGINAL

[75] Inventors: Martinus J. M. Van Heel; Theodorus F. Lamboo; Bauke J. Roelevink, all of Roosendaal, Netherlands

[73] Assignee: U.S. Philips Corporation, New York, N.Y.

[21] Appl. No.: 688,780

[22] Filed: Apr. 18, 1991

[30] Foreign Application Priority Data

May 14, 1990 [NL] Netherlands ..... 9001130

[51] Int. Cl.[5] ..... H01J 61/44

[52] U.S. Cl. ..... 313/487; 313/488

[58] Field of Search ..... 313/487, 488

[56] References Cited

U.S. PATENT DOCUMENTS

| | | | |
|---|---|---|---|
| 4,246,905 | 1/1981 | Corth | 313/487 X |
| 4,251,750 | 2/1981 | Gallien et al. | 313/487 |
| 4,882,520 | 11/1989 | Tsunekawa et al. | 313/488 X |
| 4,940,918 | 7/1990 | Rutfield | 313/487 |

*Primary Examiner*—Palmer C. DeMeo
*Attorney, Agent, or Firm*—Lesley Rhyne

[57] ABSTRACT

Low-pressure mercury vapor discharge lamp with an emission spectrum according to a spectral energy distribution comprising the wavelength ranges 380–490 nm, 490–590 nm, and 590–700 nm, within which wavelength ranges mutually equal or substantially equal quantities of energy are emitted with a tolerance of 25% for the mutual ratios of equal energy of 1:1:1.

2 Claims, 1 Drawing Sheet

LOW-PRESSURE MERCURY VAPOR DISCHARGE LAMP SUITABLE FOR ILLUMINATING A COLOR ORIGINAL

BACKGROUND OF THE INVENTION

The invention relates to a low-pressure mercury vapour discharge lamp having a closed discharge vessel containing mercury and rare gas and provided on its inside with a luminescent layer which comprises at least one luminescent material, the lamp showing emission of radiation according to a spectral energy distribution during operation.

Such lamps, which are also called fluorescent lamps, are known and are used for many purposes depending on their emission spectrum.

OBJECTS AND SUMMARY OF THE INVENTION

The invention has for its object to provide a low-pressure mercury vapour discharge lamp which is particularly suitable for illuminating a colour original which is to be sensed by a three-colour sensing arrangement (red, green and blue) and subsequently represented or reproduced. This might be the case, for example, in sensing a colour original by means of a three-colour camera followed by representation on a colour picture screen, or scanning of the colour original by a colour scanner comprising three spectral sensors in a colour copier followed by reproduction.

To achieve the envisaged object, a low-pressure mercury vapour discharge lamp of the kind described in the opening paragraph is according to the invention characterized in that the spectral energy distribution comprises the wavelength range 380–490 nm, 490–590 nm, and 590–700 nm, within which wavelength ranges mutually equal or substantially equal quantities of energy are emitted with a tolerance of 25% for the mutual ratios of equal energy of 1:1:1.

A low-pressure mercury vapour discharge lamp is obtained in this way by means of which all colours present in the colour original are recognized and represented or reproduced correctly and in a natural way, while metamerism (a colour impression of the original which is different form that under, for example, sunlight) is avoided.

A favourable embodiment of a low-pressure mercury vapour discharge lamp according to the invention is characterized in that the luminescent layer comprises as its luminescent materials:

a) 33 to 44% by weight of a white luminescing alkaline earth metal halophosphate activated by trivalent antimony and bivalent manganese,
b) 27 to 36% by weight of a blue luminescing alkaline earth metal halophosphate activated by trivalent antimony,
c) 20 to 40% by weight of red luminescing yttrium oxide activated by trivalent europium.

It is achieved in this way that during operation of the lamp about one third of the total quantity of radiant energy supplied by the lamp is emitted in each of the three spectral ranges 380–490 nm, 490–590 nm, and 590–700 nm.

The luminescent materials mentioned are known per se.

A further favourable embodiment of a low-pressure mercury vapour discharge lamp according to the invention, in which the discharge vessel is of a tubular shape having an at least substantially circular cross-section, is characterized in that the luminescent layer extends over only part of the circular circumference of the discharge vessel and in that a reflecting layer is present between the luminescent layer and the discharge vessel wall.

Such a reflector lamp which is provided with a window is particularly suitable for use in colour copiers.

BRIEF DESCRIPTION OF THE DRAWING

Embodiments of the low-pressure mercury vapour discharge lamp according to the invention are explained with reference to drawings, in which.

DESCRIPTION OF THE PREFERRED EMBODIMENTS

Figure 1:
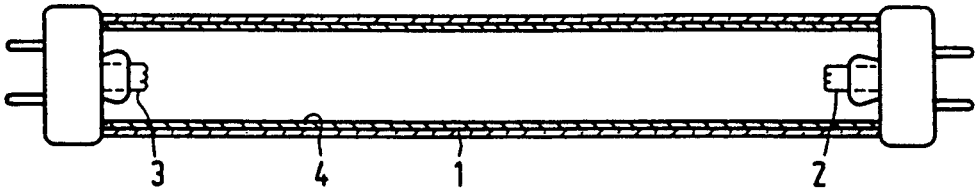
FIG. 1 shows a low-pressure mercury vapour discharge lamp in longitudinal section.

The low-pressure mercury vapour discharge lamp of FIG. 1 has a closed discharge vessel 1 which contains mercury and a rare gas, for example argon, as a starting gas. Electrodes 2 and 3 are arranged inside the discharge vessel 1, between which electrodes the discharge is maintained during operation of the lamp. The discharge vessel 1 is provided with a luminescent layer 4 on the inside, which layer comprises at least one luminescent material which shows emission upon excitation by mainly 254 nm radiation from the mercury discharge. During operation the lamp shows an emission spectrum having a spectral energy distribution which comprises the wavelength ranges 380–490 nm, 490–590 nm, and 590–700 nm. Mutually equal or substantially equal quantities of radiant energy are emitted in these wavelength ranges with a tolerance of 25% for the ratios of equal energy 1:1:1. Such a spectral energy distribution of mutually equal or substantially equal quantities of energy emitted in the same wavelength ranges may be realised, for example, through the use of three luminescent materials consisting of a white luminescing alkaline earth metal halophosphate activated by $Sb^{3+}$ and $Mn^{2+}$, a blue luminescing alkaline earth halophosphate activated by $Sb^{3+}$, and a red luminescing $Y_2O_3$ activated by $Eu^{3+}$.

In a practical embodiment, a TLD 36 W lamp (lamp length approximately 120 cm; internal tube diameter approximately 25 mm) was realised, the luminescent layer 4 comprising:

1,44 g $Ca_{10}(PO_4)_6(F, Cl)$: Sb,Mn
1,17 g $Ca_{10}(PO_4)_6F_2$: Sb
0,65 g $Y_2O_3$: Eu.

The emitted quantities of energy within each of the three wavelength ranges were, respectively:

380–490 nm: 33%
490–590 nm: 37%
590–700 nm: 30%.

Figure 2:
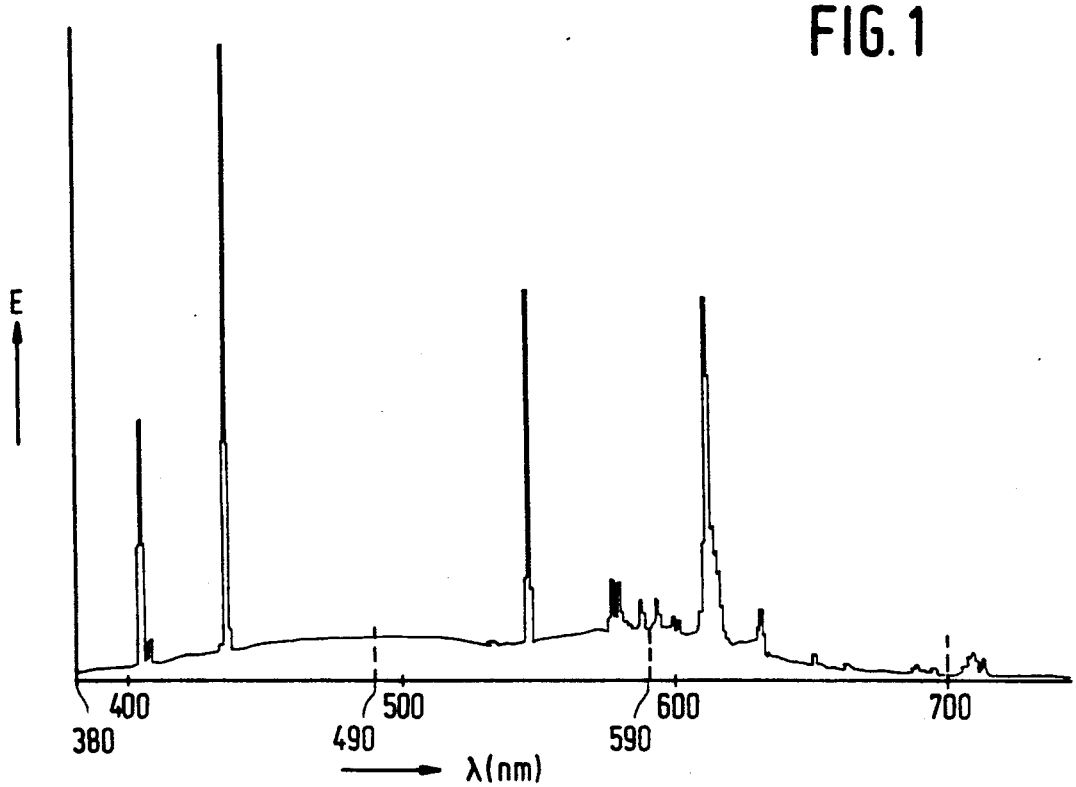
FIG. 2 shows the emission spectrum of a low-pressure mercury vapour discharge lamp according to the invention.

The emission spectrum of this lamp is shown in FIG. 2. The wavelength λ (in nm) is plotted on the horizontal axis, the emitted energy E (in arbitrary units) is plotted on the vertical axis.

Figure 3:
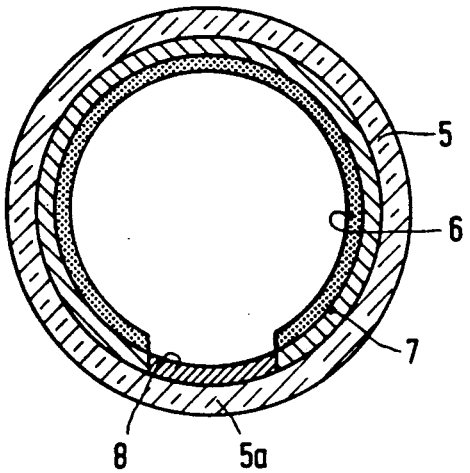
FIG. 3 shows a low-pressure mercury vapour discharge lamp provided with a window, in cross-section.

The lamp of FIG. 3 has a tubular glass discharge vessel 5 which is provided on its inside with a luminescent layer 6 which again comprises as luminescent materials: white luminescing calcium halophosphate activated by $Sb^{3+}$ and $Mn^{2+}$, blue luminescing calcium halophosphate activated by $Sb^{3+}$, and red luminescing $Y_2O_3$ activated by $Eu^{3+}$. The luminescent layer 6 extends over only part of the circular circumference of the discharge vessel 5. A reflecting layer 7, for example consisting of titanium oxide, is present between the luminescent layer 6 and the wall of the discharge vessel 5. Thus a reflector lamp having a window 5*a* is obtained, through which window the generated radiation can pass to the exterior. The window 5*a* is provided on its inside with a transparent amorphous layer 8 of $TiO_2$, which protects the glass window 5*a* against the mercury discharge. Such a lamp is particularly suitable for use in colour copiers.

We claim:

1. A low-pressure mercury vapour discharge lamp having a closed discharge vessel containing mercury and rare gas and provided on its inside with a luminescent layer which comprises at least one luminescent material, the lamp showing emission of radiation according to a spectral energy distribution during operation, wherein the spectral energy distribution comprises the wavelength ranges 380–490 nm, 490–590 nm, and 590–700 nm, within which wavelength ranges mutually equal or substantially equal quantities of energy are emitted with a tolerance of 25% for the mutual ratios of equal energy of 1:1:1, characterized in that the luminescent layer comprises as its luminescent materials: a) 33 to 44% by weight of a white luminescing alkaline earth metal halophosphate activated by trivalent antimony and bivalent manganeses, b) 27 to 36% by weight of a blue luminescing alkaline earth metal halophosphate activated by trivalent antimony, c) 20–40% by weight of red luminescing yttrium oxide activated by trivalent europium.

2. A low-pressure mercury vapour discharge lamp as claimed in claim 1, in which discharge vessel is of tubular shape and has an at least substantially circular cross-section, characterized in that the luminescent layer extends over only part of the circular circumference of the discharge vessel and in that a reflecting layer is present between the luminescent layer and the discharge vessel wall.

* * * * *